US007082731B2

(12) United States Patent
Patz et al.

(10) Patent No.: US 7,082,731 B2
(45) Date of Patent: Aug. 1, 2006

(54) INSULATED CONCRETE WALL SYSTEM

(76) Inventors: Murray Patz, 1612 Greenfield Ave., Sheboygan, WI (US) 53081; Jon Kraus, 10709 Tube Dr. 100, Hurst, TX (US) 76053

( * ) Notice: Subject to any disclaimer, the term of this patent is extended or adjusted under 35 U.S.C. 154(b) by 93 days.

(21) Appl. No.: 10/233,931

(22) Filed: Sep. 3, 2002

(65) Prior Publication Data

US 2004/0040240 A1 Mar. 4, 2004

(51) Int. Cl.
*E04B 2/00* (2006.01)

(52) U.S. Cl. ..... 52/426; 52/309.11; 52/383; 52/432; 52/562; 52/565; 52/410

(58) Field of Classification Search ..... 52/410–412, 52/416–422, 425–426, 432, 442, 562–572, 52/309.2, 309.12, 309.11, 383, 428
See application file for complete search history.

(56) References Cited

U.S. PATENT DOCUMENTS

| | | | | |
|---|---|---|---|---|
| 4,516,372 | A | 5/1985 | Grutsch | |
| 4,706,429 | A | 11/1987 | Young | |
| 4,730,422 | A | 3/1988 | Young | |
| 4,731,968 | A | 3/1988 | Obino | |
| 4,742,659 | A | 5/1988 | Meilleur | |
| 4,765,109 | A | 8/1988 | Boeshart | |
| 4,866,891 | A | 9/1989 | Young | |
| 4,884,382 | A | 12/1989 | Horobin | |
| 4,888,931 | A | 12/1989 | Meilleur | |
| 4,901,494 | A | 2/1990 | Miller et al. | |
| 5,140,794 | A | 8/1992 | Miller | |
| 5,367,845 | A | 11/1994 | Hartling | |
| 5,390,459 | A | 2/1995 | Mensen | |
| 5,428,933 | A | 7/1995 | Philippe | |
| 5,625,989 | A * | 5/1997 | Brubaker et al. | 52/309.12 |
| 5,657,600 | A | 8/1997 | Mensen | |
| 5,735,093 | A | 4/1998 | Grutsch | |
| 5,890,337 | A * | 4/1999 | Boeshart | 52/426 |
| 5,992,114 | A | 11/1999 | Zelinsky et al. | |
| 6,230,462 | B1 * | 5/2001 | Beliveau | 52/426 |
| 6,256,962 | B1 * | 7/2001 | Boeshart | 52/745.09 |
| 6,324,804 | B1 * | 12/2001 | Hoogstraten | 52/426 |
| 6,363,683 | B1 | 4/2002 | Moore, Jr. | |
| 6,526,713 | B1 * | 3/2003 | Moore, Jr. | 52/309.11 |
| 6,609,340 | B1 * | 8/2003 | Moore et al. | 52/309.11 |
| 6,820,384 | B1 | 11/2004 | Pfeiffer | |
| 6,915,613 | B1 * | 7/2005 | Wostal et al. | 52/426 |
| 2004/0040240 | A1 | 3/2004 | Patz et al. | |

* cited by examiner

*Primary Examiner*—Jeanette E. Chapman
(74) *Attorney, Agent, or Firm*—Ryan Kromholz & Manion, S.C.

(57) ABSTRACT

An insultated wall system comprises a plurarity of foldable blocks, each having two panels of rigid insulated foam, multiple inserts embedded in the panels, and ties between pairs of inserts. Each insert has one or more connectors, each with an end hole that swivelably receives the end leg of a tie in a manner that enables the block to fold. Each connector further has a top opening that releaseably captures the middle leg of the tie and rigidly locks the block against folding. The connectors are double-ended, and the inserts are invertible in the panels. Corner and T-walls are made by simple cuts in the standard blocks. Plates and ties are used to hold together the blocks of a main wall and an intersecting T-wall. The connectors of a panel may contact either the connectors of the other panel, or the other panel itself, when the block is folded.

6 Claims, 12 Drawing Sheets

18
36A
36
16
14
30
22
34
26
20
32
36B 63
61'
75
69'
81
73E
13
67
76
73EA
81A
75A
61A'
71
73
61
69
77
79
D1
D2
D3
61A
71A
73A
69A

INSULATED CONCRETE WALL SYSTEM

BACKGROUND OF THE INVENTION

1. Field of the Invention

This invention pertains to wall construction, and more particularly to apparatus for erecting insulated concrete walls.

2. Description of the Prior Art

It is well known to construct walls using insulated concrete forming systems. For the purposes of the present invention, the term "insulated concrete forming" means a concrete forming system using stay-in-place forms of foam plastic insulation for constructing cast-in-place concrete walls. Insulated concrete forming systems combine the inherent structural integrity of concrete with the energy efficiency of rigid insulation.

Typically, insulated concrete forming systems include a number of blocks, each comprising a pair of parallel panels spaced apart by the thickness of the concrete wall. The panels are held to each other at the proper spacing by ties of metal, plastic, or other material. The blocks are stacked on top of and alongside each other to suit a particular wall. After all the blocks have been are erected in place, concrete is poured in the space between the panels.

Representative companies that manufacture insulated concrete forming systems include R-Forms, Inc. of Naples, Fla.; and Poly-Forms LLC of Taftville, Conn. Other examples of insulated concrete forms may be seen in U.S. Pat. Nos. 4,706,429; 4,730,422; 4,731,968; 4,765,109; 4,866,891; 4,884,382; 5,140,794; 5,428,933; 5,625,989; 5,657,600; 5,735,093; 5,992,114; and 6,363,683. The form of the foregoing patents are rigid in that the panels are always spaced a fixed distance apart.

U.S. Pat. Nos. 4,742,659, 4,888,931, 4,901,494 and 5,890,337 disclose forms that have at least limited capabilities of folding. However, none of the foldable forms is rigidly lockable in the unfolded configuration.

A common characteristic of many prior insulated concrete forming systems was that the panels were rigidly tied together at the factory to make a block. As a result, the envelopes of the blocks were fixed. The space between the panels occupied a large percentage of the total block envelope. The space between the panels, which was vital for eventually receiving poured concrete, nevertheless was highly undesirable for shipping and storage purposes. In some prior designs, the ties were separate from the panels such that the panels could be laid flat against one another for shipping and storage. Once the ties were assembled between two panels, however, the resulting blocks were permanently rigid unless the ties were removed.

Prior insulated concrete forming systems suffered another handicap concerning corners of a wall. To suit both L-corners and T-corners, the prior systems required special blocks. The costs associated with designing, manufacturing, storing, and using multiple kinds of corner blocks was undesirable.

Thus, despite the widespread availability of insulated concrete forming systems, further developments to them are desirable.

SUMMARY OF THE INVENTION

In accordance with the present invention, an insulated concrete wall system is provided that greatly simplifies the process of constructing insulated concrete walls. This is accomplished by apparatus that includes panels, inserts, and ties that are incorporated into foldable blocks.

The panels are made of conventional rigid insulative foam material such, but not limited to, as expanded polystyrene. The panels can be of any practical height, length, and thickness. The panel top and bottom surfaces are formed with interlocks such as short posts and matching cavities.

Embedded in the interior face of each panel are a number of inserts. The inserts are made from a tough but slightly flexible plastic material, such as, but not limited to, nylon or polypropylene. Each insert in comprised of a planar base and at least one web upstanding from the base. The web supports one or more connectors. Each connector has a top surface parallel to the plane of the base and a notch defined by an end surface and a side surface. There is an end hole in the notch end surface. An arcuate portion of the end hole is in the notch side surface. The connector further has an opening in the top surface. The longitudinal axis of the top opening is perpendicular to and intersects the longitudinal centerline of the end hole. The longitudinal axis of the top opening lies in the plane of the notch end surface. The top opening is bounded by the notch end and side surfaces such that the top opening subtends an angle of approximately 270 degrees. The diameter of the top opening is substantially the same as the diameter of the end hole. Preferably, the notch side surface is not coplanar with the end hole longitudinal centerline or the top opening longitudinal axis. Projecting on opposite sides of the connector are a pair of tabs. The tabs lie in a plane that is parallel to the plane of the base. The connector end hole and top opening cooperate to releaseably lock a tie to the insert. The tie is made from a steel wire that is bent to have a pair of end legs and a middle leg. The tie steel wire has a diameter sized to fit with a specific clearances in the connector end hole and top opening.

To lock a tie to a connector, an end leg of the tie is Inserted into the connector end hole. The tie is inserted until the tie middle leg contacts the notch end surface. At that point, the longitudinal centerline of the tie middle leg is offset from the top opening longitudinal axis by an amount equal to the rod radius. The tie can be swiveled such that the tie middle leg is within approximately 20 degrees of being parallel to the top opening longitudinal axis, at which point the tie middle leg contacts the notch side surface. The tie is locked to the connector by applying a swivel force to the tie against the notched side surface while simultaneously applying a linear force that pushes the tie end leg further into the connector end hole. That action causes a deflection of the connector material sufficient to allow the tie middle leg to enter the top opening. Immediately thereafter, the connector material around the top opening resiliently returns to its undeflected condition. The tie middle leg is then captured in the top opening, and the tie is locked to the connector.

It is an important feature of the present invention that each connector is double-ended. That is, the notch end and side surfaces, end hole, and top opening are duplicated on opposite ends of the connector. The end holes of the double-ended connector are preferably coincident. As a result, the insert is invertible when embedded in a panel.

In another aspect of the invention, two double-ended connectors are used with each insert. The connectors may be supported by separated webs, in which case the connectors are preferable joined by a longitudinally extending plate.

The bases and webs of as many inserts as desired are embedded into a panel. The tabs of the connectors are used to hold the inserts in place in a mold while the panel material is formed up around the inserts webs and bases.

The multiple ties and inserts are used to hold two panels together and form the block of the invention. One end leg of a tie is inserted into the end opening of an insert connector in one panel. The other end leg of the tie is inserted into the end hole of an insert connector in another panel. When the ties are pushed and swiveled as described, the ties lock to the inserts to make a rigid block.

In accordance with a further aspect of the invention, however, the ties and inserts also act as hinges that enable the blocks to fold and unfold. For that purpose, the tie end legs are inserted into the associated connector end holes, but the ties are not locked to the connectors. In that situation, the ties end legs can swivel in the respective connectors. Doing so moves the panels closer to and further away from each other, while always keeping them parallel to each other. Only when the ties are locked to the connectors do the panels remain rigidly at a fixed distance apart. In that manner, the blocks are foldable for shipping and storage. At the job site, the blocks are unfolded for erecting into forms for a wall.

At the job site, as many blocks as required are stacked on top of and alongside each other to create a form for a poured concrete wall. The thickness of the poured wall is determined by the length of the ties middle legs. The interlocks on the panels top and bottom surfaces hold adjacent blocks in place. When the forms have been erected from the individual blocks, concrete is poured to make a very strong insulated wall.

Further in accordance with the present invention, special blocks for corners and T-walls are not necessary. To make a form for a corner, the external panel of a first block is cut an amount equal to the thickness of the external panel of the intersecting block of the intersecting wall. The internal panel of the first block is cut an amount equal to the overall width of the intersecting block. The external panel of the intersecting block does not require any cutting. The internal panel of the intersecting block is cut an amount equal to the thickness of the external panel of the first block plus the thickness of the concrete of the first wall. Thus, three simple cuts through three panels are sufficient to make a corner.

The two corner blocks are partially held together by the inserts and ties as described above. In addition, another tie is used between the external panel of each corner block and a tie that is between the two panels of the intersecting block. In that manner, the blocks maintain their rigidity at the corners without any need for special corner blocks.

To form a T-wall, the present invention further includes two pairs of inside and outside T-wall plates. No changes are required to one panel of the block of a main wall at the intersection with two T-wall. The other panel of the main wall block is cut out by an amount equal to the thickness of the concrete of the T-wall. An outside T-wall plate mates with the interlocks of the uncut panel of the main wall block opposite each panel of the intersecting T-wall block. An inside T-wall plate mates with the interlocks of each panel of the intersecting wall block and with the cut panel of the main wall block. A tie is inserted through holes in the inside and outside T-wall plates. The blocks at a T-wall are thus firmly held together without any need for special blocks.

The versatility of the present invention is further demonstrated by the ability to pour very thin concrete walls. The lower limit of wall concrete thickness is twice the height of the insert connectors, i.e., the connectors of the inserts in the two block panels abut. In that case, staple-shaped ties rather than the ties previously described are used to hold the block panels together.

The method and apparatus of the invention, using multiple ties that are releasably lockable in insert connectors, thus erect insulative forms for poured concrete walls. The same blocks are used at corners and T-walls, even though the blocks can be folded for shipping and storage.

Other advantages, benefits, and features of the present invention will become apparent to those skilled in the art upon reading the detailed description of the invention.

BRIEF DESCRIPTIONS OF THE DRAWINGS

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

General

Figure 1:
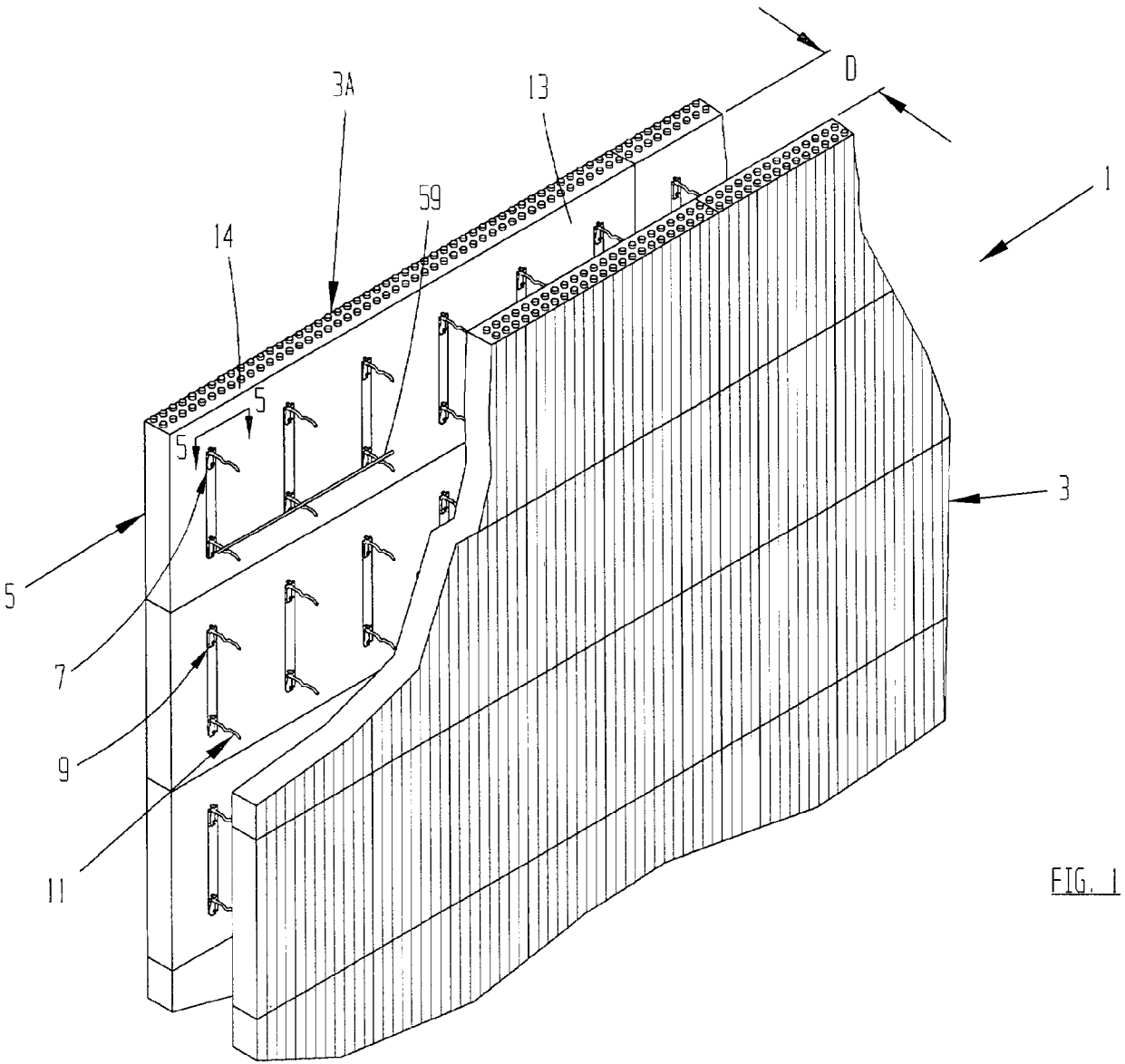
FIG. 1 is a perspective view of a typical insulated concrete wall system according to the present invention.

Referring to FIG. 1, an insulated concrete wall system 1 is illustrated that includes the present invention. The insulated concrete wall system 1 is comprised of a number of interfitting blocks 3 that are designed, constructed, and used according to the present invention.

Each block 3, such as block 3A, is made of two panels 5 of a rigid insulating foam. A number of inserts 7 are embedded into each panel 5. Each insert 7 has at least one connector 9 that is exposed. The connectors 9 of the inserts of two panels are held together with ties 11 such that the panels are parallel to each other. The panels are spaced apart a distance D that is determined by the length of the ties 11.

The blocks 3 are stacked on top of and alongside each other in the outline of the wall of a building or other structure. As many blocks are used as are required for the particular job at hand. After all the blocks are in place, the space 13 between their panels 5 is filled with concrete and appropriate reinforcing items. The concrete cures to make a very strong and insulated wall.

Panels

Figures 2, 3, 4:
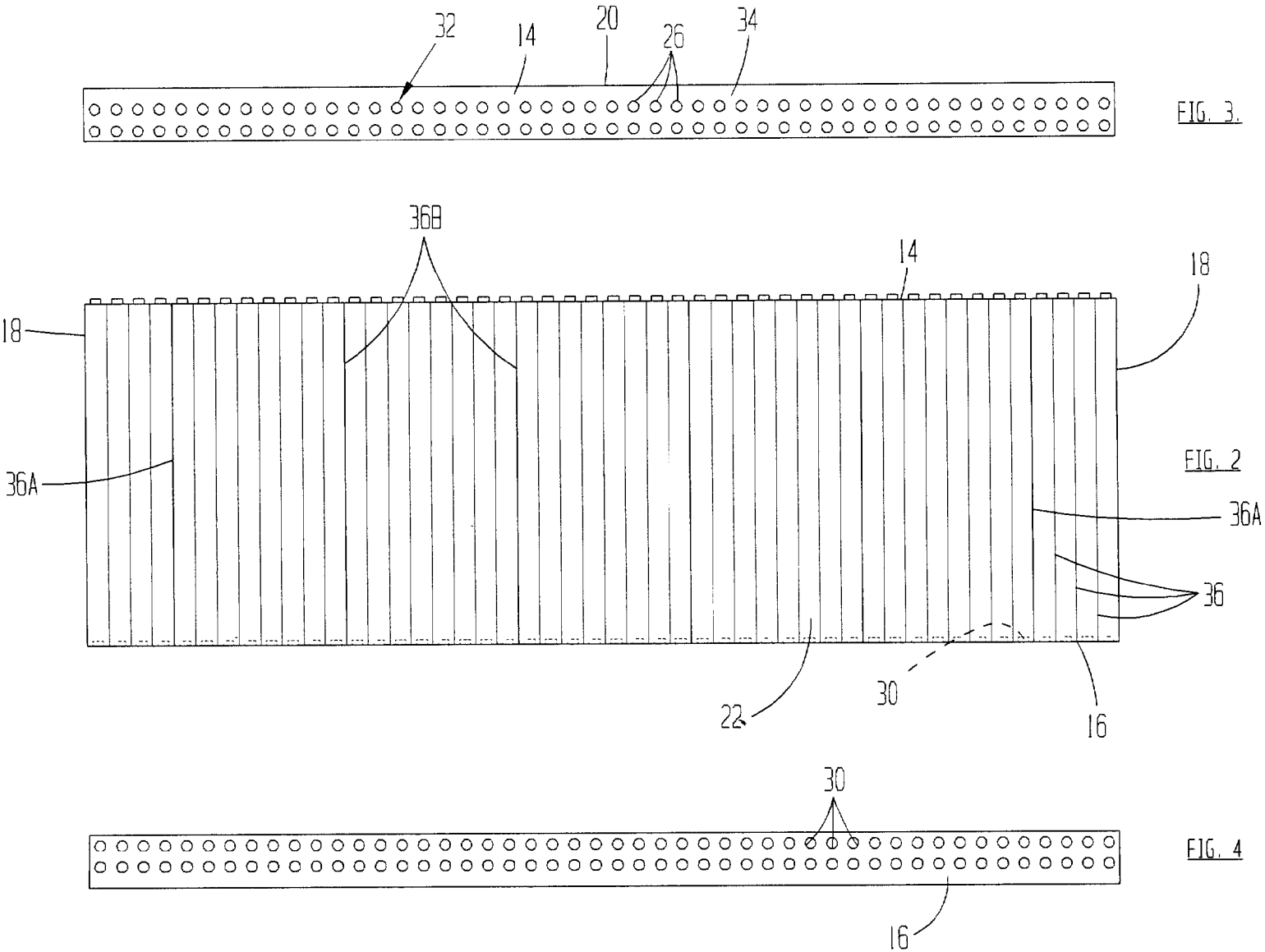
FIG. 2 is a front view of the exterior face of a panel of the present invention.
FIG. 3 is a top view of FIG. 2.
FIG. 4 is a bottom view of FIG. 2.
Figure 7:
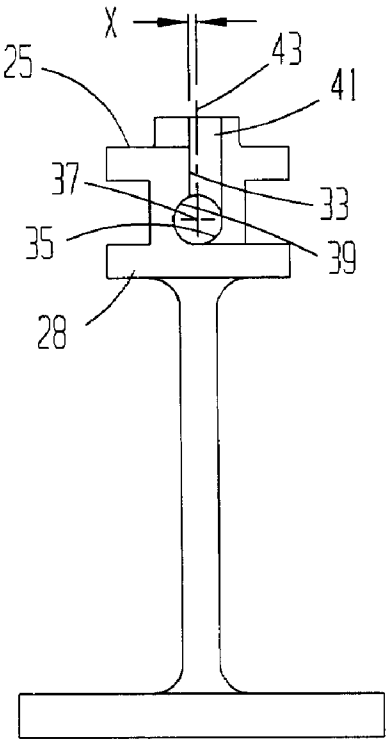
FIG. 7 is an end view of FIG. 6.

Looking also at FIGS. 2–4, the two panels 5 of each block 3 are rectangular in shape, having a top surface 14, a bottom surface 16, and end surfaces 18. Each panel also has an interior face 20 and an exterior face 22. The panel is made from a sturdy and rigid but lightweight insulative material. A preferred material is a foam made of expanded polystyrene. Although the panels can be of any practical size, we prefer a size of 16 inches high, 48 inches long, and 2.50 inches thick. It will be appreciated that panels of other dimensions are also fully within the scope of the present invention.

The panels 5 include interlocks 32. The illustrated interlocks 32 are a pattern of short posts 26 on one of the panel top or bottom surfaces 14 or 16, respectively. The other top or bottom surface of each panel has a complimentary pattern of cavities 30. Although the posts 26 and cavities 30 are shown as being round, other shapes such as squares or octagons are also acceptable. The preferred spacing of the interlocks posts and cavities is 1.00 inches. The number of rows of the posts and cavities in the interlocks is dependent upon the thickness of the panel. When the panel thickness permits, a land 34 is provided between the panel interior face 20 and the adjacent row of posts or cavities.

On the exterior face 26 of each panel 5 are a number of grooves 36. Each groove 36 runs from the top surface 14 to the bottom surface 16. The grooves are preferably one inch apart. The grooves at four inches from the end surfaces 18, designated at reference numerals 36A, are two grooves that are separated slightly. There are additional double grooves 36B at eight inch spacings from the grooves 36A.

Insert

Turning to FIGS. 5–9, the insert 7 of the invention includes a base 15 that defines a plane 17. One or more webs 19 upstand from the base 15. At least one, and preferable two, connectors 9 are supported on the web 19. As illustrated, there are two identical connectors 9 and 9' supported by respective webs and 19'.

Each connector 9 and 9' has a pair of side walls 10 and 12, and end walls 38 and 40. The connector further has a top surface 25. A pair of flanges 23 and 24 project transversely from the side walls 10 and 12, respectively. A pair of tabs 27 and 28 project transversely from the side walls at the top surface 25. The two connectors are joined by a plate 21, which preferably is aligned with the flanges 23 and 24.

In each connector end wall 38 is a notch 29. The notch is defined by an end surface 31 between the flange 23 and the top surface 25. The notch is also defined by a side surface 33 between the flange 23 and the top surface. Preferably, the planes of the ends and side surfaces 31 and 33, respectively, are perpendicular to each other and also perpendicular to the plane 17 of the base 15.

In the notch end surface 31 is a hole 35. The longitudinal centerline 37 of the end hole 35 is perpendicular to the notch end surface. The longitudinal centerline 37 of the end hole 35 is offset by a distance X from the notch side surface 33 in the direction of the flange 28. The offset distance X is less than the diameter of the end hole 35. Consequently, there is an arcuate recess 39 in the notch side surface 33 that is an extension of the end hole 35.

In the connector top surface 25 is an opening 41. The top opening 41 has a longitudinal axis 43 that is perpendicular to and that intersects the longitudinal centerline 37 of the end hole 35. The top opening has a diameter equal to that of the end hole. The top opening longitudinal axis 43 lies in the plane of the notch end surface 31. Consequently, the top opening subtends an angle of approximately 270 degrees. In the particular connector 9 illustrated, there is a ridge 45 on the top surface 25 around the top opening.

It is an important feature of the present invention that each connector 9 and 9' is double-ended. The connector 9, for example, has a second notch 29' that is defined by an end surface 31' and side surface 33'. The end hole 35 extends completely through the connector between the two end surfaces 31 and 31'. There is a second top opening 41' in the top surface 25 at the second notch 29'. A rib 46 on the top surface 25 connects the two ridges 45 and 45' around the top openings 41 and 41', respectively. The ridges 45 and 45' have a common upper face 48 with the rib 46.

Preferred dimensions for the insert 7 include a length of approximately 15 inches and a base width of approximately 1.50 inches. The web height is approximately two inches, and the height H from the flanges 23 and 24 to the upper face 48 is 0.50 inches. The distance between the longitudinal axes 43 of the top openings 41 of the two connectors is eight inches, and the longitudinal axes 43 are at equal distances from the ends of the base.

Tie

Figure 10:
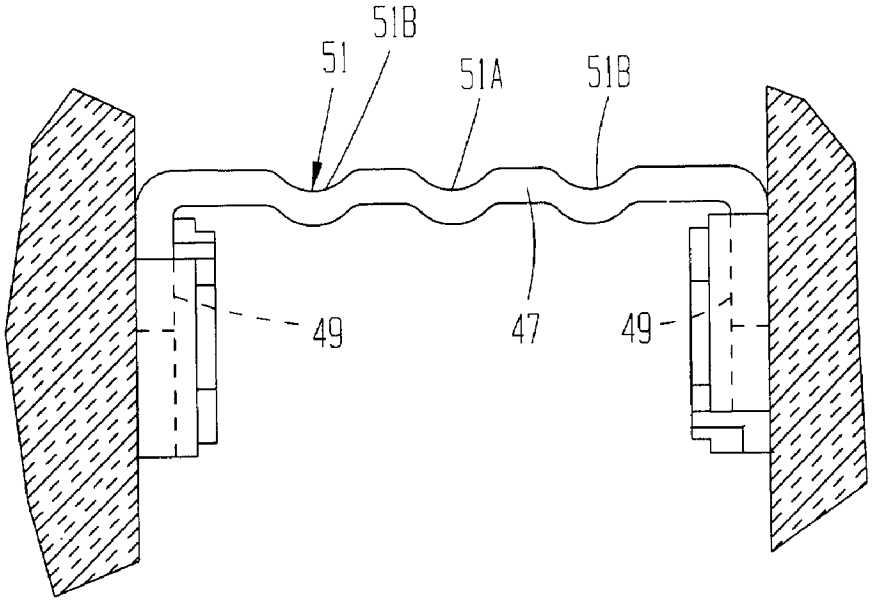
FIG. 10 is a view showing a tie holding two panels of a block of the invention.

The tie 11 is best shown in FIG. 10. The ties are made from metal material, such as steel. Each tie has a middle leg 47 and two end legs 49. The tie legs 45 and 49 have a diameter that is slightly less than the diameter of the end holes 35 and top openings 41 and 41' in the connectors 9.

In the middle leg 47 of each tie 11 are a number of seats 51. The middle leg may be bent as shown to produce the seats 51. There are preferably a center seat 51A and two side seats 51B, although that particular arrangement is not critical for the operation of the present invention. A satisfactory diameter for the tie material is a circular rod of 0.19 inches diameter. The end legs 49 may be approximately 1.50 inches long. The length of the middle leg is variable as will be explained in detail presently.

Assembly and Operation

Figure 5:
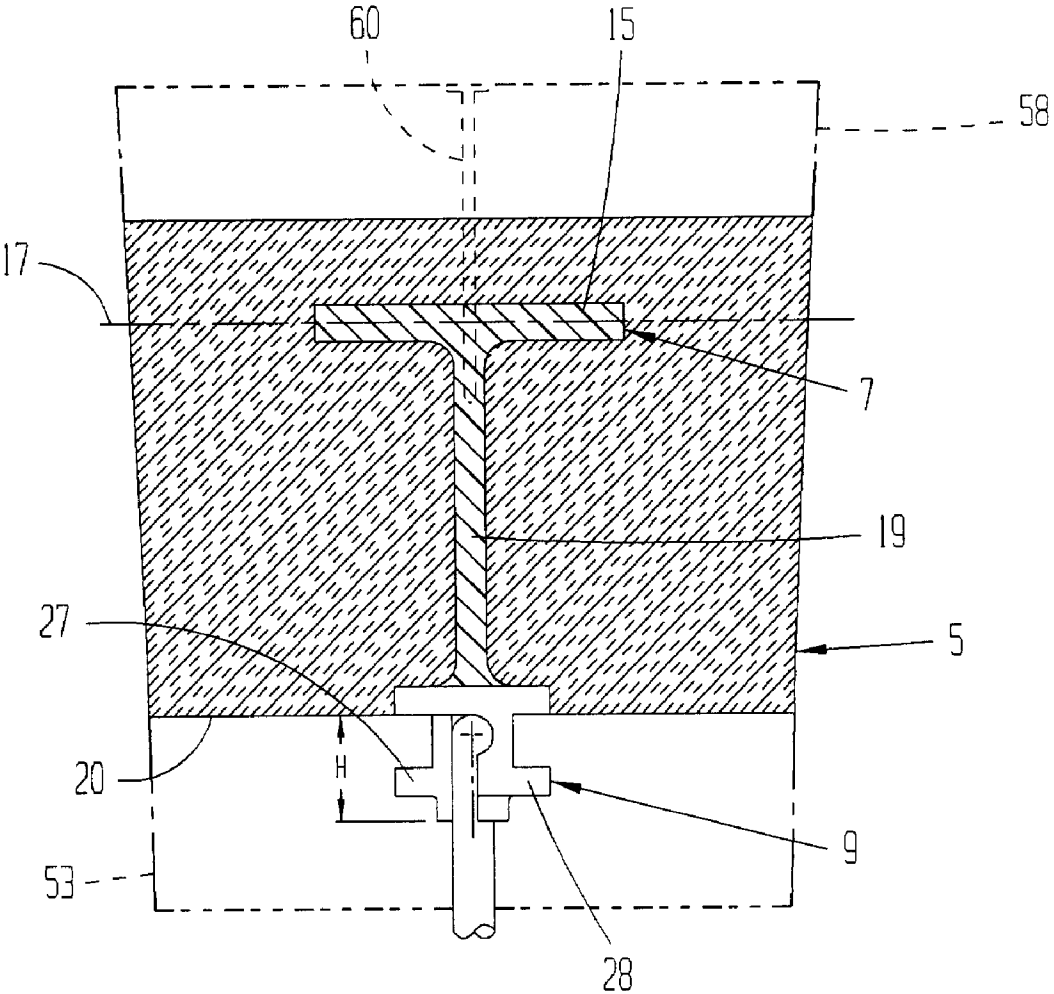
FIG. 5 is a cross-sectional on an enlarged scale taken along line 5—5 of FIG. 1.
Figure 6:
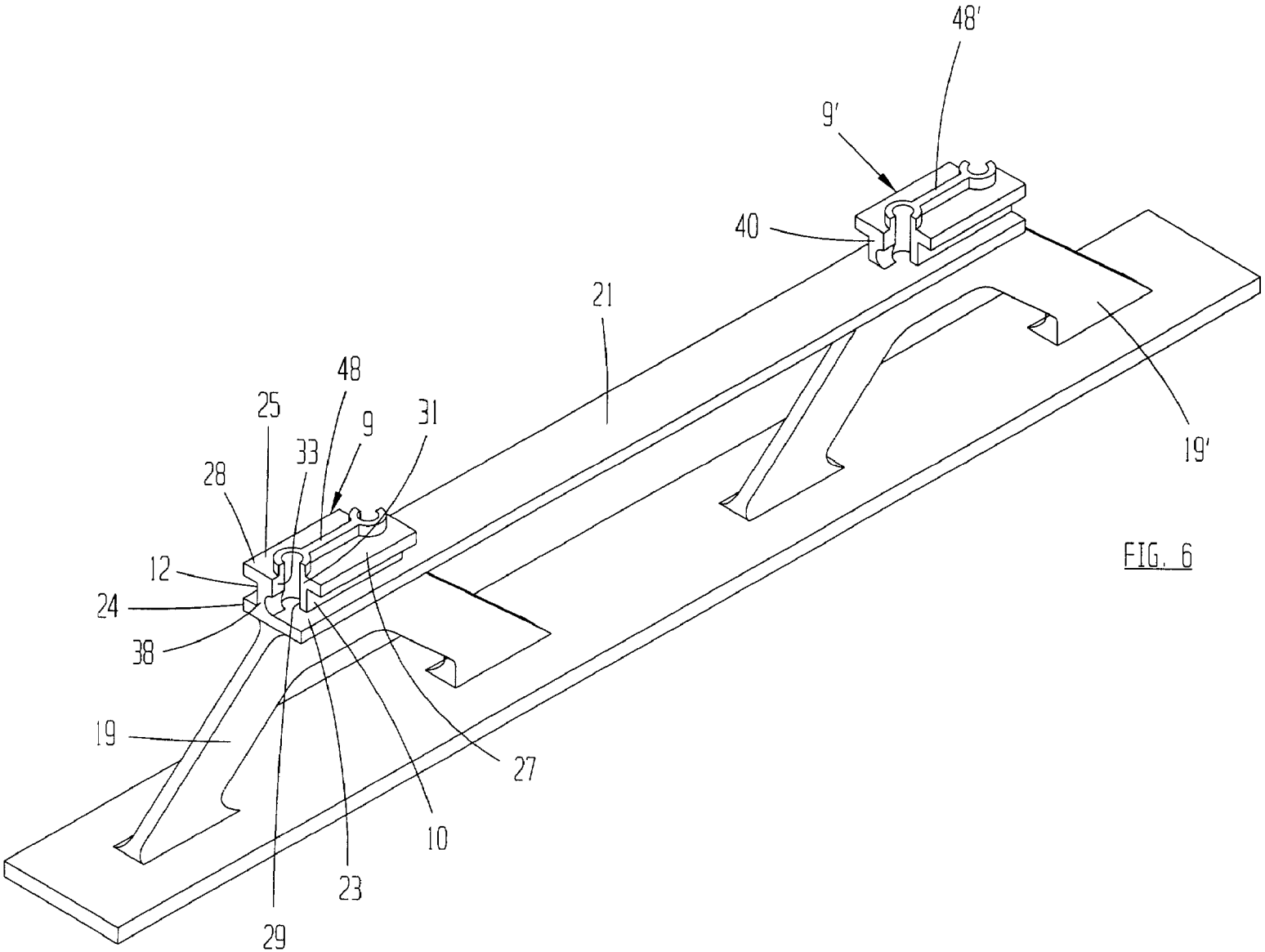
FIG. 6 is a perspective view of the insert of the invention.
Figure 8:
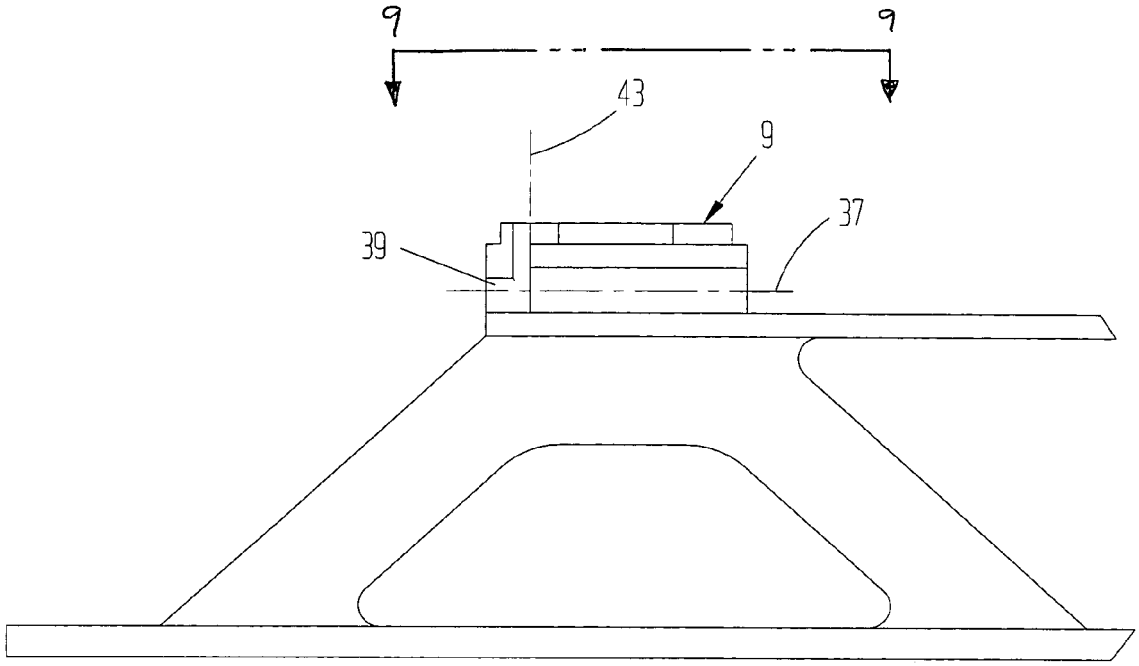
FIG. 8 is a front view of a portion of the insert of the invention.
Figure 9:
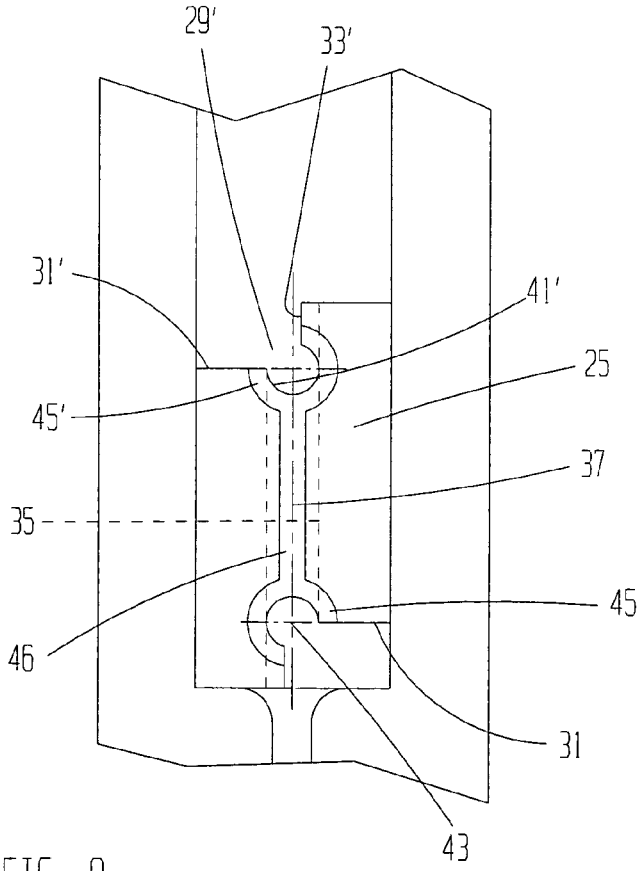
FIG. 9 is a view on an enlarged scale taken along line 9—9 of FIG. 8 and rotated 90 degrees counterclockwise.

With particular attention to FIG. 5, the inserts 7 are embedded in the panel 5 at the factory. For that purpose, the connectors 9 and 9' of an insert are retained in an aluminum mold represented by phantom lines 53. The connector tabs 27 and 28 cooperate with slots in the mold 53 to keep the inserts in place. The presence of the two connectors 9 and 9', plus the fact that the connectors are double-ended, renders the inserts invertible in the mold. Consequently, orientation mistakes when loading the inserts into the mold are eliminated. It is preferred that the inserts be centered between the panel top and bottom surfaces 14 and 16, respectively. For a panel that is 16 inches high and an insert with a 15 inch base 15, the longitudinal axes 43 of the connectors are then four inches from the top and bottom surfaces. The inserts are further located so as to be centered on the grooves 36A and 36B. Accordingly, six inserts are used for a 48 inch long panel.

The mold 53 is filled with a selected insulative material such as expanded polystyrene in a manner well known in the art. After the mold is removed, a rigid panel 5 has been produced having twelve connectors 9 and 9' spaced on an eight inch grid exposed in the panel interior face 20. For the particular insert 7 described, the height H of the connectors above the panel interior face is 0.50 inches.

The panels 5 with the inserts 7 are ready to be assembled into the blocks 3. Two panels are placed in parallel facing relation. A tie 11 is used between associated connectors 9 or 9'. One tie end leg 49 is pushed partially into the end hole of a connector of one panel, and the other tie end leg is pushed partially into the end hole of a connector of the second panel. The two panels are thus held together to make a block 3. The panels are at a distance apart equal to the length of the tie middle leg 47.

Figure 11A:
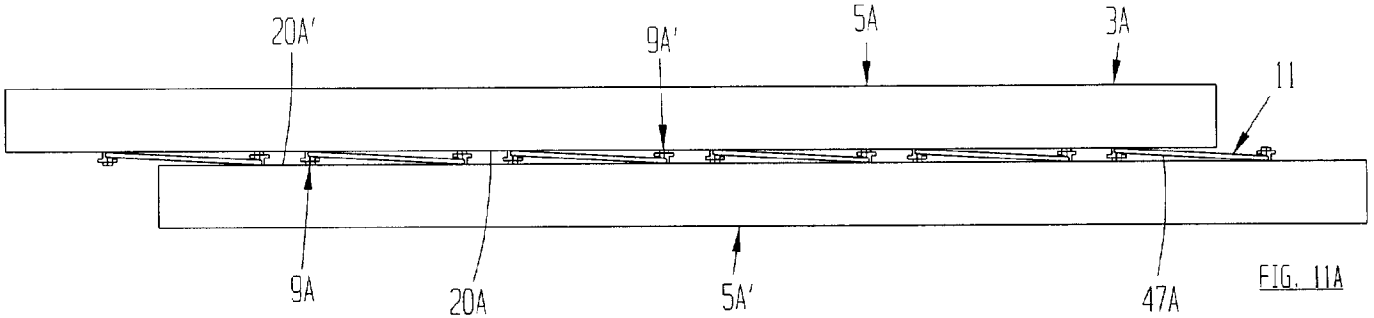
FIGS. 11A–11C are schematic diagrams of typical blocks according to the invention shown in folded conditions.
Figure 11B:
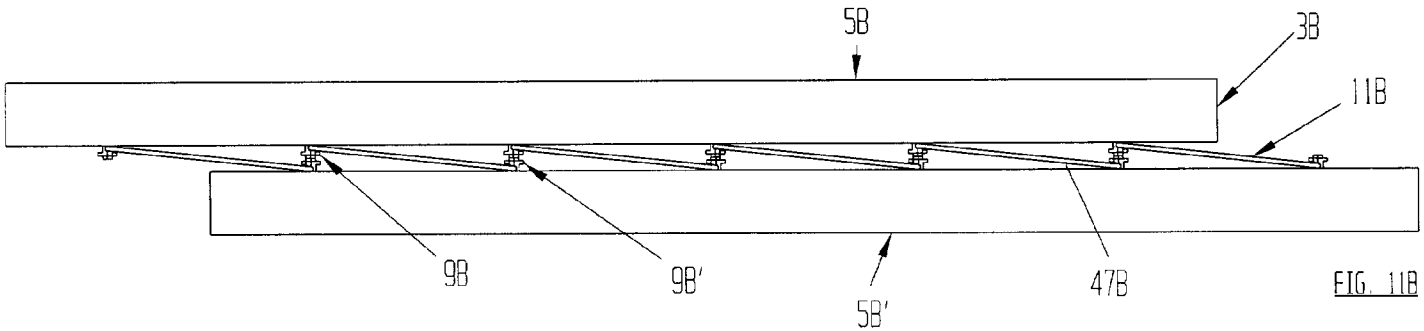
Figure 11C:
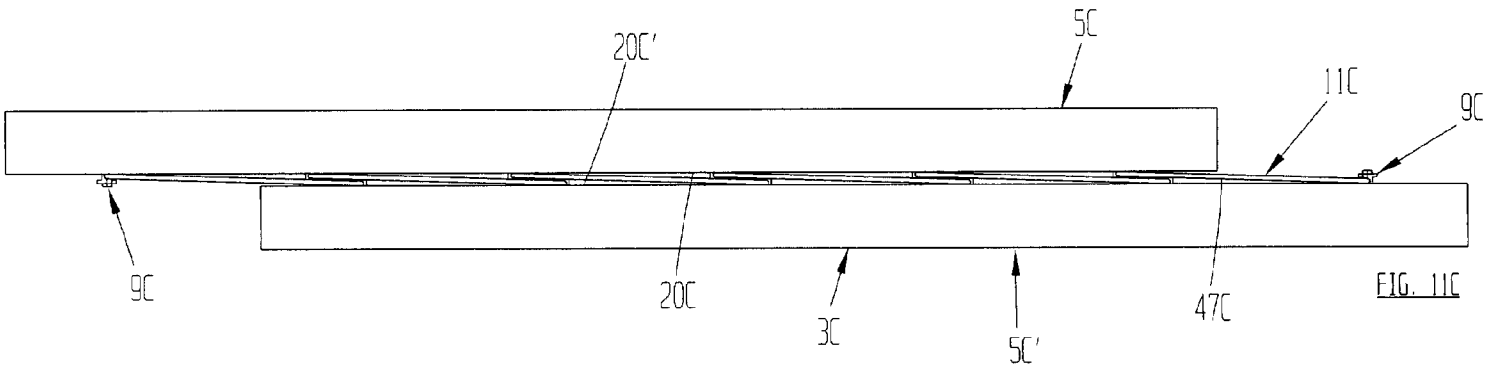

According to an important aspect of the invention, the insert connectors 9 and the ties 11 cooperate to act as hinges that enable the blocks 3 to fold. FIGS. 11A–11C show three typical configurations of folded blocks. In FIG. 11A, a block 3A has a first panel 5A with connectors 9A, and a second panel 5A' with connectors 9A'. The length of the ties middle legs 47A is less than the spacings between connectors 9A and 9A'. Consequently, swiveling the ties end legs in the associated connector end holes 35 enables the connectors 9A to contact the interior face 20A' of the panel 5A', and the connectors 9A' to contact the interior face 20A of the panel 5A. The envelope of the folded block 5A is thus reduced by a distance equal to the length of the tie middle legs 47A minus the height H of the connectors compared with the envelope of the unfolded block.

In FIG. 11B, the lengths of the tie middle legs 47B is equal to the spacings between the connectors 9B and 9B' of the panels 5B and 5B', respectively. In that situation, the opposing connectors 9B and 9B' contact when the block 3B is folded. The envelope of the folded block 3B is reduced by a distance equal to the length of the middle legs 47B of the ties 11B minus twice the height H of the connectors 9B and 9B'.

In FIG. 11C, the lengths of the middle legs 47C of the ties 11C is greater than the spacings between the connectors 9C and 9C'. In that situation, the connectors 9C and 9C' contact the interior faces 20C' and 20C, respectively, of the panels 5C' and 5C when the block 3C is folded. The envelope of the folded block 5C is reduced by an amount equal to the length of the ties middle legs 47C minus the height of the connectors 9C and 9C'.

Figure 12:
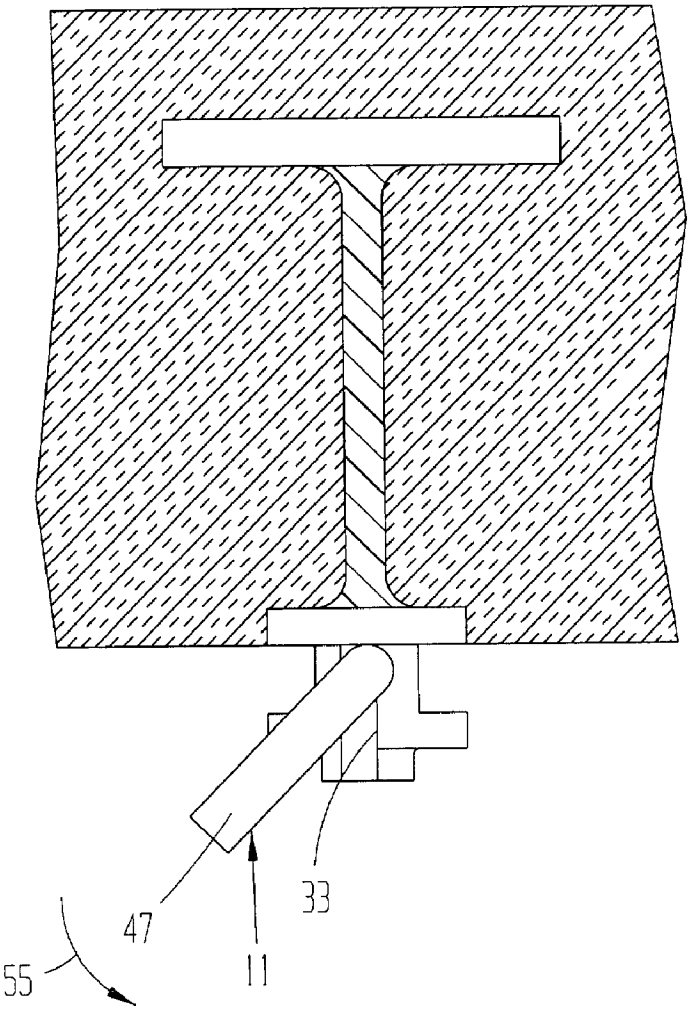
FIG. 12 is a view generally similar to FIG. 5, but showing a tie that is not locked in a connector.

At the job site, the blocks 3 are unfolded, FIG. 1, by swiveling the ties end legs 49 in the end holes 35 of the connectors 9. See FIG. 12. As the ties 11 swivel in the direction of arrow 55, their middle legs 47 approach and contact the side surfaces 33 of the associated connector notches 29. From that point, the ties 11 are further swiveled in the direction of arrow 55. The insert material deflects slightly in the regions of the side surfaces to enable the tie middle legs to snap into the associated connector top openings 41. The connector material resiliently returns to its undeflected configuration. At that point, the tie middle legs are locked in the connectors, and the block is rigid.

The blocks 3 are stacked on top of and alongside of each other into a form 57. The interlocks 32 aide in keeping the blocks in place. Steel reinforcing rods 59 are laid in selected seats 51A or 51B of the ties 11. When the form 57 and reinforcing rods 59 are completed, concrete is poured in the space 13.

After the concrete has cured, a very strong and insulated wall has been created. The grooves 36A and 36B indicate the bases 15 of the inserts 7. The grooves are very helpful for subsequent construction operations such as attaching drywall or other sheet goods 58 with fasteners 60 to the insulated concrete wall. The tabs 27 and 28 help anchor the inserts to the cured concrete and thereby provide resistance against the drywall fasteners 60. Other types of wall finishes and building accessories can also be securedly fastened to the completed insulated concrete wall by means of the inserts. The metal ties 11 as opposed to ties made of plastic or combustible materials, prevent burn through in the event of intense fires. It is anticipated that a six inch net concrete wall will achieve a four hour fire rating.

Corners

Figures 13, 13A:
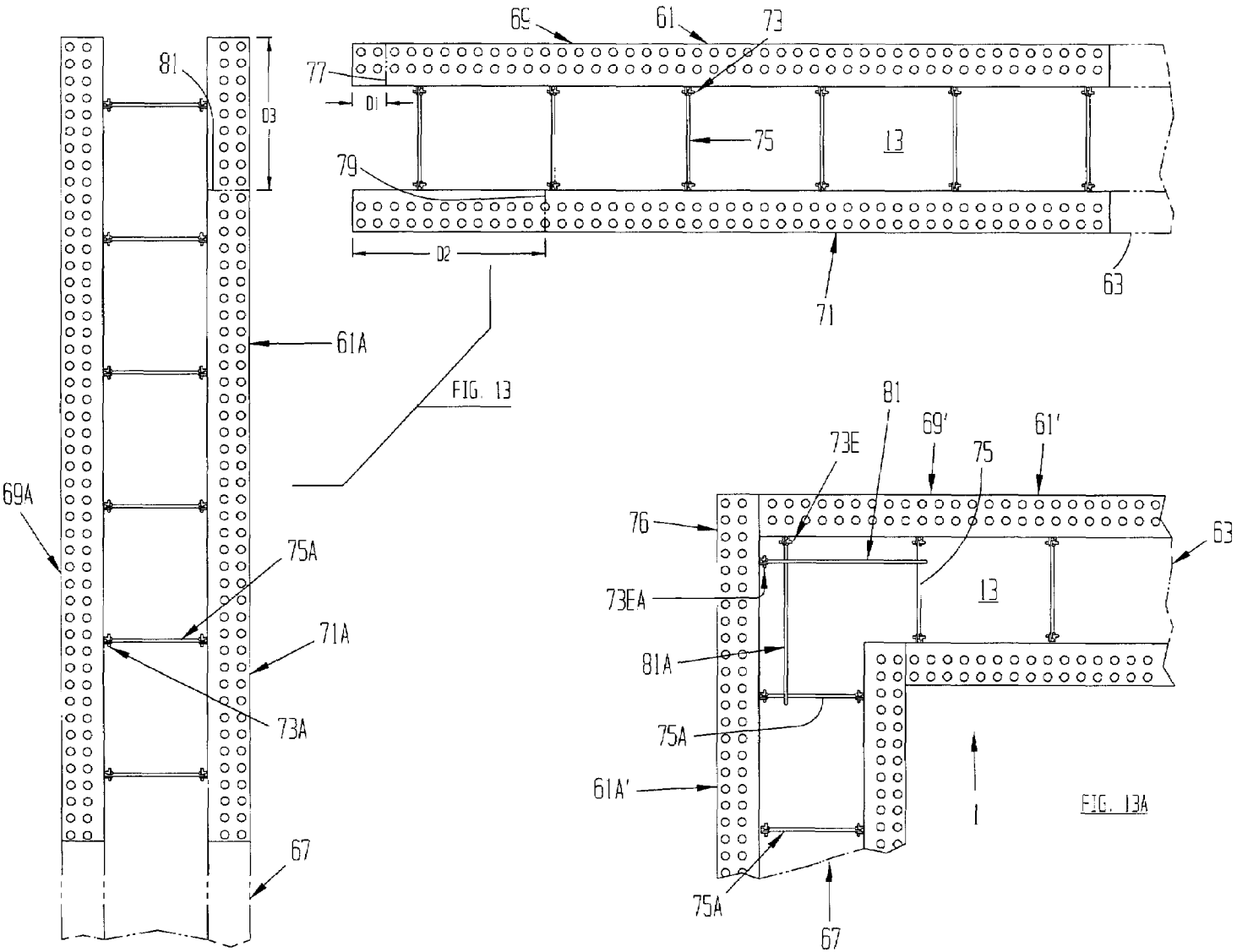
FIG. 13 is a top view of two standard blocks used for a corner.

Further in accordance with the present invention, the standard block 3 of the invention may be modified to use at corners of two intersecting walls. Turning to FIGS. 13 and 13A, a first block 61 for a first wall 63 is at a corner 76 with a second block 61A of an intersecting wall 67. The blocks 61 and 61A are identical to the blocks 3 of the invention as described previously. The block 61A has an external panel 69 and an internal panel 71, each with inserts 73 and ties 75. The block 61A has an external panel 69A, internal panel 71A, inserts 73A, and ties 75A. The blocks 61 and 61A need not have equal length ties 75 and 75A, respectively.

To make the corner 76 of the walls 63 and 67, the external panel 69 of the block 61 is cut at line 77 by an amount D1 equal to the thickness of the external panel 69A of the block 61A. The internal panel 71 of the block 61 is cut at line 79 by an amount D2 equal to the full width of the block 61A. The internal panel 71A of the block 61A is cut at line 81 by an amount D3 equal to the thickness of the external panel 69 of the block 61 plus the spacing 13 between the two panels of the block 61. The cuts are easily made using common hand or power tools by using the grooves 36 located on the exterior face 22 of the panels as guidelines (FIGS. 1 and 2). With the three cuts 77, 79, and 81 made, the two resulting blocks 61' and 61A' are placed in perpendicular intersecting arrangement as shown in FIG. 14A.

It will be noticed in FIG. 13A that the usual ties 75 and 75A do not work with the end inserts 73E and 73EA of the blocks 61 and 61A, respectively. To properly hold the panels 69' and 69A' in place, two corner ties 81 and 81A are used. The corner tie 81 is used between the insert 73E of the block 61 and the closest tie 71A of the block 61A. The corner tie 81A is used between the insert 73EA of the block 61A and the closest tie 75 of the block 61. For both the corner ties 81 and 81A, one end leg is inserted into the end hole 35 of the associated insert 73E or 73EA. The other tie leg is hooked over an associated tie 75 or 75A. In that manner, a corner 76 of the insulated concrete wall system 1 is constructed without the requirement of making or storing any special components at the factory.

T-Walls

Figure 14:
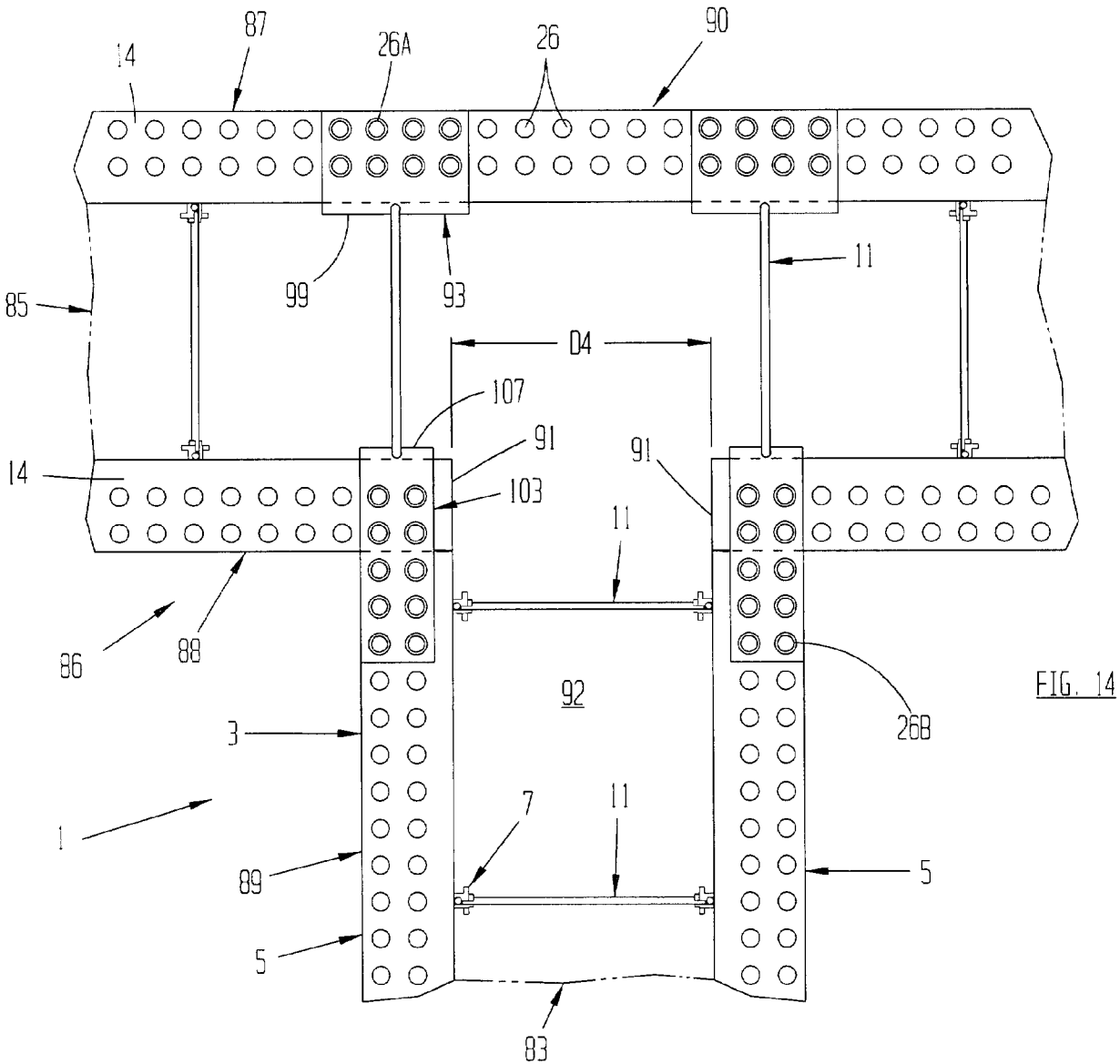
FIG. 14 is a top view of a T-wall according to the present invention.
Figure 16:
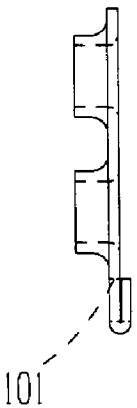
FIG. 16 is an end view of FIG. 15.
Figure 15:
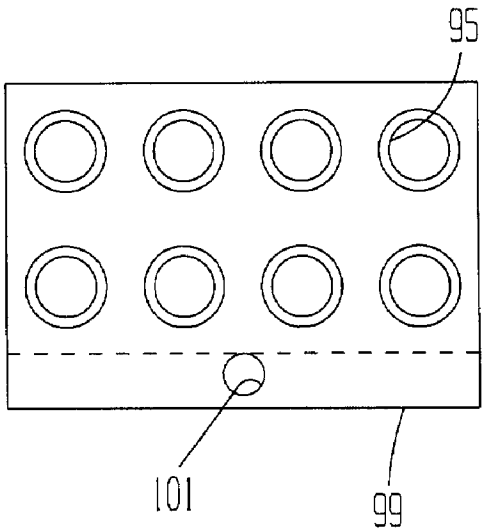
FIG. 15 is a top view of an outside T-wall plate according to the invention.
Figure 18:
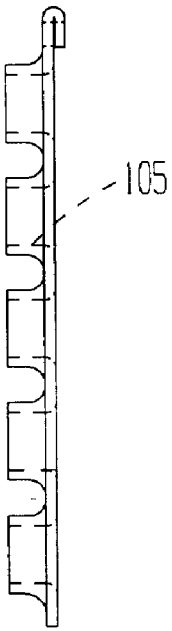
FIG. 18 is an end view of FIG. 17.
Figure 17:
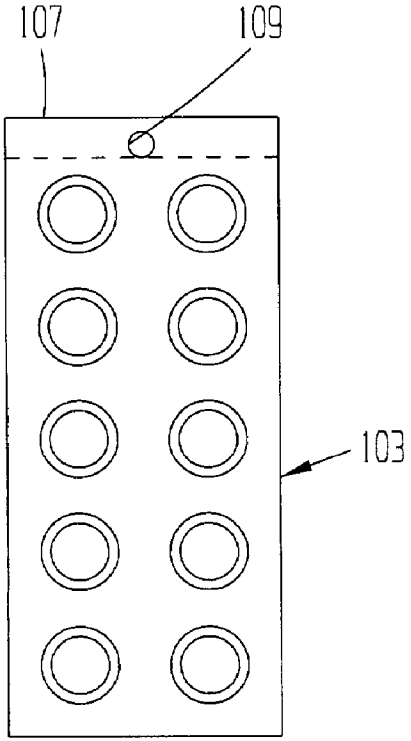
FIG. 17 is a top view of an inside T-wall plate according to the invention.

Next looking at FIGS. 14–18, the present invention is further concerned with erecting T-walls of the insulated concrete wall system 1. In FIG. 14, a T-wall 83 intersects a main wall 85. The T-wall 83 and main wall 85 may have different total widths. At the intersection 86, the main wall 85 has a block 87, and the T-wall has a block 89. The T-wall block 89 is a standard block 3 with inserts 7 and ties 11. The main wall block 87 is also factory made as a standard block 3 according to the present invention.

To suit the T-wall intersection 86, one panel of the block 87 is cut along lines 91 a distance D4 equal to the width of the concrete of the T-wall. Both panels 5 of the T-wall block 3 are brought into contact with the cut panel 88 of the block 87. The space 92 between the panels 5 is aligned with the cut lines 91.

To hold the second panel 90 of the block 87 to the T-wall block 3, four plates are used together with the standard ties 11. Two outside T-wall plates 93 are constructed as specialized stamped plates having a number of holes 95. The holes 95 are sized and spaced to fit over and receive several interlock posts 26A of the second panel 90 of the block 87. One edge 99 on the outside T-wall plate 93 is turned over at 180 degrees. A hole 101, which is meant to receive one leg 45 of the tie 51, is through the double layer of material at the turned-over edge 99.

An inside T-wall plate 103 also has a number of holes 105 for fitting over and receiving the posts 26B of the panels 5 of the block 3. An edge 107 of the inside T-wall plate 103 is turned over at 180 degrees. A hole 109, which is meant to receive one leg 49 of the tie 51, is through the double layer of material in the turned-over edge 107.

In use, an inside T-wall plate 103 is placed over each of the panels 5 of the block 3. The turned-over edge 107 and hole 109 simulate the connector 9 and end hole 35 of an insert connector 9. An outside T-wall plate 93 is placed over the second panel 90 of the block 87 opposite each of the panels 5 of the block 3. The turned-over edge 99 and hole 101 of the outside T-wall plate simulate the connector 9 and end hole 35 of an insert 7. A tie 11 is used between the holes 101 and 109 on the outside and inside T-wall plates, respectively, to hold the blocks 3 and together. The simple cuts 91 in the blocks of the invention plus the simple outside and inside T-wall plates obviate the need for special blocks for T-walls. For both the intersections 76 and 86, cutting the standard blocks 3 as described maintains the vertical and horizontal alignments of the inserts connectors 9. Accordingly, no strength from the ties 11 is lost.

Modified Insert

Figure 19:
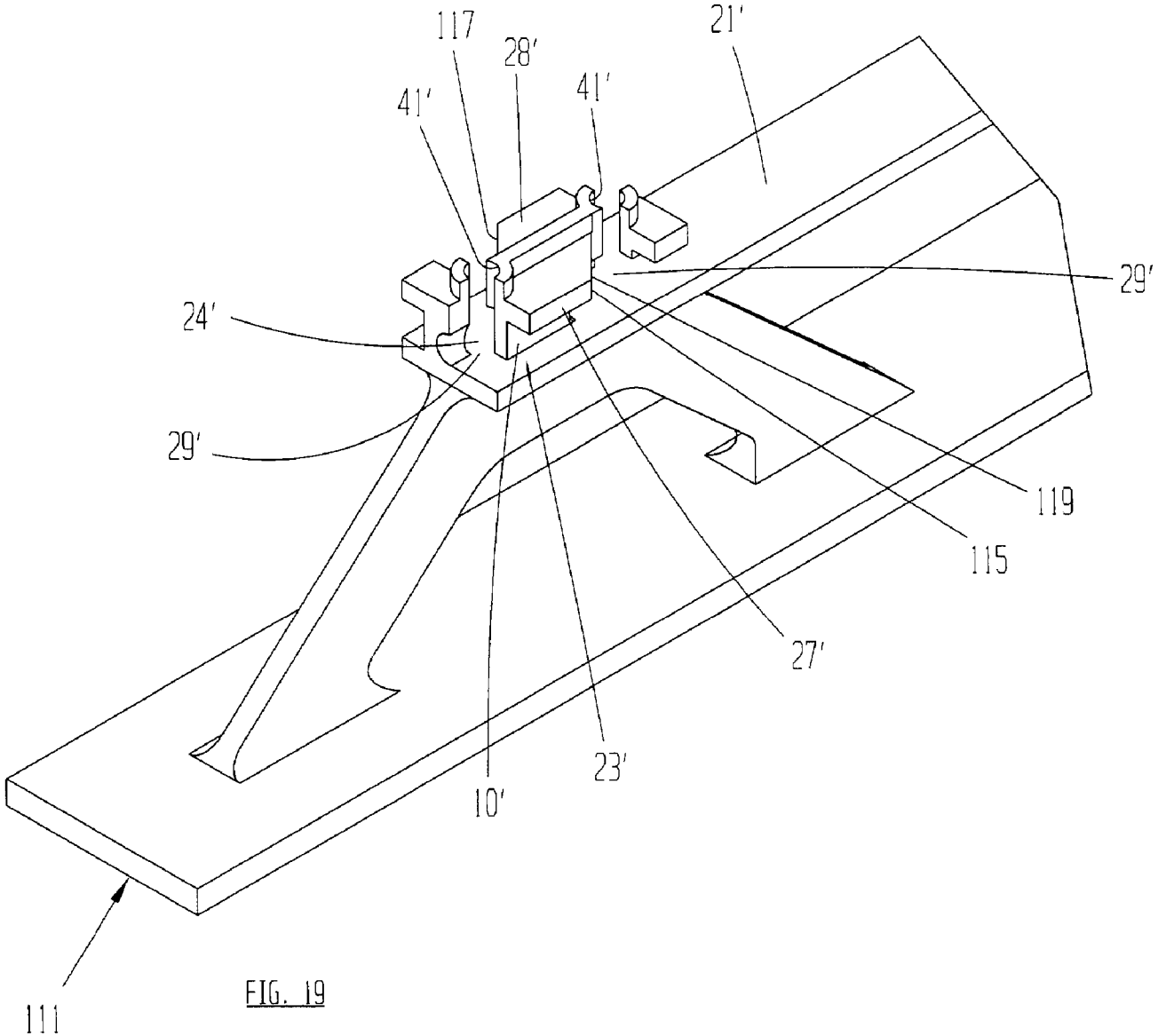
FIG. 19 is a perspective view of modified insert according to the present invention.
Figure 20:
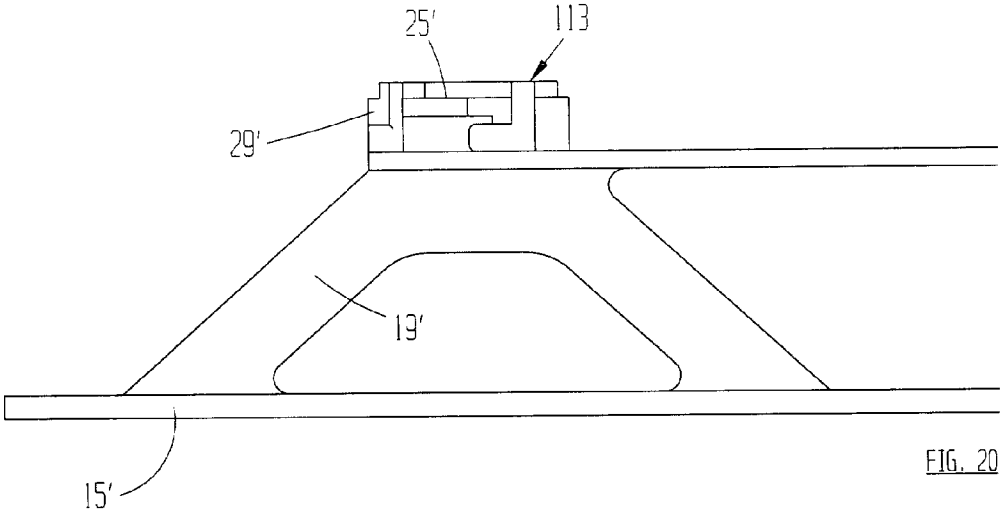
FIG. 20 is a partial front view of the modified insert of FIG. 19.
Figure 21:
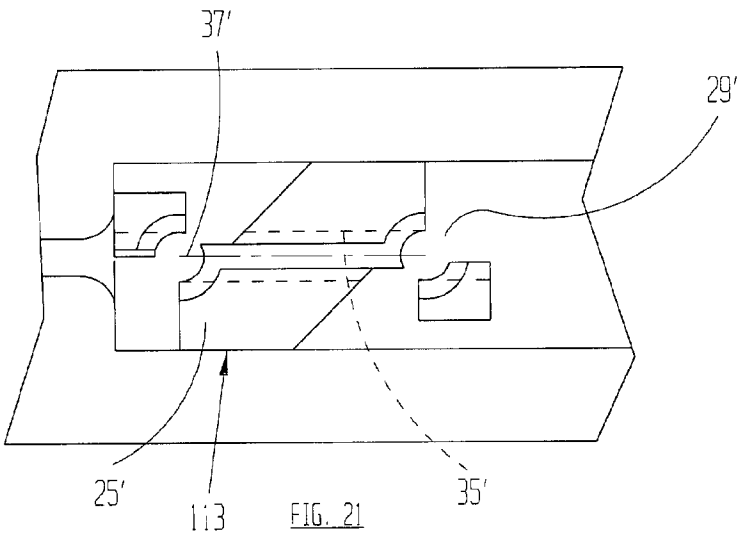
FIG. 21 is a top view of the modified insert.

An important aspect of the present invention is that the inserts lend themselves to being economically manufactured. It is contemplated that the inserts will be manufactured on a production basis from a plastic material by an injection molding process. As described, the insert 7 is entireably suitable for being molded in conventional manner. To simplify the molding process, especially as it pertains to the end holes 35 in the connectors 9 and 9', a modified insert 111 has been developed. See FIGS. 19–21. The insert 111 has a base 15', and webs 19'. The modified insert is invertible, having two double-ended connectors 113 that are supported on the webs 19'. Each connector 113 has a top surface 25', two notches 29', an end hole 35' with a longitudinal centerline 37', flanges 23' and 24', tabs 27' and 28', and top openings 41' and 41A. The two connectors of an insert may be connected by a plate 21' that is aligned with the flanges 23' and 24'.

To avoid the expense of a mold that must reciprocate in the directions parallel to the end hole longitudinal centerline 37, the connectors 113 are made with cutouts 115 and 117. The cutout 115 is through the tab 27' and side wall 10' and breaks into the end hole 35'. One edge 119 of the cutout 115 may be at an angle to the side wall 10, if desired. The cutout 115 also breaks into the top opening 41'. The cutout 117 is substantially identical to the cutout 115. Because of the cutouts, only mold reciprocation perpendicular to the longitudinal centerline 37' is required to make the end hole 35' in the insert 111; no mold reciprocation parallel to the end hole longitudinal centerline 37' is needed. The cutouts 115 and 117 have no effect on the performance of the connectors.

Thin Concrete Wall.

Figure 22:
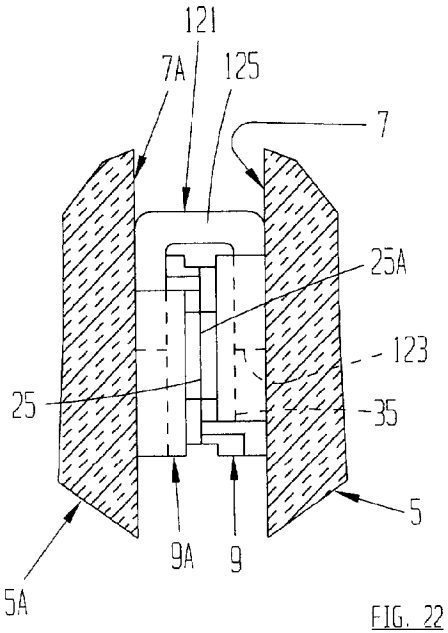
FIG. 22 is a cross sectional view of a block using a staple shaped tie.

The versatility of the present invention is further demonstrated with regard to FIG. 22. In some buildings, it is desirable to pour very thin concrete walls. With the present invention, walls having a concrete thickness as little as twice the height H of the connectors can be constructed. In those situations, the usual ties 11 are not used. Instead, metal staple shaped ties 121 are used. The staple shaped tie 121 has end legs 123 and a middle leg 125. Two panels 5 and 5A with inserts 7 and 7A are brought together side-by-side such that the connectors 9 and 9A abut. The staple shaped tie is of the proper length to enable its end legs 123 to the inserted into the end holes 35 of the two connectors 9 and 9A while still keeping the connectors in close contact. As a result, for an insert with a connector height H of 0.50 inches, a concrete wall only one inch thick can be poured without problem.

SUMMARY

The results and advantages of insulated concrete walls can now be more fully realized. The insulated concrete wall system 1 provides both rapid erection of the blocks 3 into forms for receiving poured concrete as well as foldability of the blocks. This desirable result comes from using the combined functions of the insert connectors 9. The ties 11 are selectively swivelable in the connector end holes 35. The ties enable the blocks to fold for shipping and storage at a job site. The connector top openings 41 cooperate with the end holes to snap lock the ties in place and render the blocks rigid. The connectors are double-ended so that the inserts 7 are invertible in the panels 5. No special blocks are required for corners of a wall. Instead, the standard blocks are cut in simple fashion to suit a corner. Similarly, no special blocks are needed for a T-wall. The specialized stamped plates 93 and 103 are used in conjunction with one cut and one standard block to suit a T-wall. The metal ties prevent burn through the insulated concrete wall system during a fire. The tabs 27 help anchor the panels to the concrete and also provide resistance to fasteners used for securing drywall and other building components to the insulated concrete wall.

It will also be recognized that in addition to the superior performance of the insulated concrete wall system of the invention, its construction is such as to cost little, if any, more than traditional insulated concrete wall systems. In fact, the versatility and productivity of the invention contributes significantly to reducing the total costs of constructing an insulated concrete wall.

Thus, it is apparent that there has been provided, in accordance with the invention, an insulated concrete wall system that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. An insert for a block for an insulated concrete wall system comprising:

a. a base having first and second ends and defining a base plane;

b. at least one web upstanding from the base; and c. a connector supported on said at least one web and having opposed side walls, first and second end walls, and a top surface, the connector defining an end hole and a first top opening that cooperate to selectively lock and release a tie to the insert, wherein:

i. there is a first notch in the connector first end wall defined by a first side surface and a first end surface;

ii. the connector end hole is in the first end surface and defines a longitudinal centerline that is parallel to the base plane; and iii. the first top opening is partially in the first end surface and partially in the first side surface.

2. The insert of claim 1 wherein the first top opening subtends an angle of approximately 270 degrees.

3. The insert of claim 2 wherein the first top opening has a longitudinal axis that is offset from the first side surface.

4. The insert of claim 1 wherein:

a. there is a second notch in the connector second end wall defined by a second end surface and a second side surface;

b. the end hole extends through the first and second end surfaces; and c. there is a second top opening in the top surface that is partially in the second side surface and the second end surface, so that the insert connector is double-ended.

5. An insert for a block for an insulated concrete wall system comprising:

a. a base having first and second ends and defining a base plane;

b. at least one web upstanding from the base; and c. a connector supported on said at least one web and having opposed side walls, first and second end walls both perpendicular to the side walls, and a top surface parallel to the base plane, the connector defining an end hole and a first top opening that cooperate to selectively lock and release a tie to the insert and wherein the insert comprises two connectors to thereby enable two ties to be locked and released from the insert, wherein:

i. each connector comprises at least one flange that projects from a selected side wall; and ii. the connectors are joined by a plate that is generally coplanar with said at least one flange and that is spaced from the base and is parallel to the base plane.

6. The insert of claim 4 wherein:

a. the insert comprises first and second double-ended connectors; and b. the first and second connectors are approximately equidistant from the base first and second ends respectively, so that the insert is invertible.

* * * * *